US006124670A

United States Patent [19]

Valone

[11] Patent Number: 6,124,670

[45] **Date of Patent: *Sep. 26, 2000**

[54] GATE-AND EMITTER ARRAY ON FIBER ELECTRON FIELD EMISSION STRUCTURE

[75] Inventor: Steven M. Valone, Los Alamos, N. Mex.

[73] Assignee: The Regents of the University of California, Los Alamos, N. Mex.

[ * ] Notice: This patent issued on a continued prosecution application filed under 37 CFR 1.53(d), and is subject to the twenty year patent term provisions of 35 U.S.C. 154(a)(2).

[21] Appl. No.: 09/087,734

[22] Filed: May 29, 1998

[51] Int. Cl.[7] ..... H01J 19/28

[52] U.S. Cl. ..... 313/495; 313/497; 313/308; 313/309; 313/336; 313/351

[58] Field of Search ..... 313/495, 496, 313/497, 308, 309, 336, 351

[56] References Cited

U.S. PATENT DOCUMENTS

| | | | |
|---|---|---|---|
| 3,755,704 | 8/1973 | Spindt et al. | 313/309 |
| 5,229,331 | 7/1993 | Doan et al. | 313/309 |
| 5,243,252 | 9/1993 | Kaneko et al. | 313/309 |
| 5,462,467 | 10/1995 | Macaulay et al. | 445/50 |
| 5,548,185 | 8/1996 | Kumar et al. | 313/495 |
| 5,578,185 | 11/1996 | Bergeron et al. | 205/123 |
| 5,578,901 | 11/1996 | Blanchet-Fincher et al. | 313/496 |
| 5,652,083 | 7/1997 | Kumar et al. | 430/315 |
| 5,659,224 | 8/1997 | Kumar et al. | 313/495 X |

OTHER PUBLICATIONS

C. A. Spindt, "A Thin–Film Field–Emission Cathode," J. Appl. Physics, vol. 39, pp. 3604–3505 (1968).

K. Matsuzaki et al., "Characteristics of Silicon–Field Emitter Arrays Fabricated by Using Wafers Separated by Implantation of Oxygen," J. Electrochem. Soc. vol. 144, No. 7, pp. 2538–2541 (Jul. 1997).

Katherine Derbyshire, Senior Technical Editor, "Flat Panel Displays, Beyond AMLCDs: Field Emission Displays?" Solid State Technology, pp. 55–65 (Nov. 1994).

*Primary Examiner*—Ashok Patel

*Attorney, Agent, or Firm*—Bruce H. Cottrell

[57] ABSTRACT

A unified fibrous field emission element is provided including a conductive fibrous central core element having an insulating material directly thereon the conductive fibrous central core element and a gate electrode directly thereon the insulating material, the conductive fibrous central core element further including emission sites situated longitudinally along the length of the conductive fibrous central core element.

6 Claims, 5 Drawing Sheets

GATE-AND EMITTER ARRAY ON FIBER ELECTRON FIELD EMISSION STRUCTURE

FIELD OF THE INVENTION

The present invention relates to field emission in triodes or more complex structures such as tetrodes. This invention is the result of a contract with the Department of Energy (Contract No. W-7405-ENG-36). The government has certain rights in the invention.

BACKGROUND OF THE INVENTION

In the area of fibrous field emitters, special coatings are sometimes applied to a base conductive fiber to form an especially good emitter. These fibrous field emitters are then used in diode or triode structures for the purpose of extracting electrons in operation of a field emission device.

In the preparation of typical triode field emitter designs, an emitter tip has been initially fabricated upon a conductive layer and a gate layer is formed upon an insulating layer upon the conductive layer. Examples of such construction can be seen in U.S. Pat. No. 5,229,331 and U.S. Pat. No. 5,243,252. Conventionally, when a field emission device has incorporated a fibrous field emission element (cathode), a gate electrode has been fabricated as a separate structure. For example, U.S. Pat. No. 5,578,901 describes several embodiments including a fibrous cathode as a field emission element and a separate gate electrode spaced apart from the fibrous cathode.

It is an object of the present invention to combine the gate electrode with a field emission structure as a unified solitary structure.

It is a further object of the present invention to combine the gate electrode upon a fibrous field emitter into a field emission structure having a unified solitary structure.

Another object of the present invention is to provide a field emission structure having a unified solitary structure with a gate electrode layer and insulating layer directly upon a fibrous core substrate where the emitter structure has emission longitudinally along the length of the fiber structure.

Yet another object of the present invention is to provide a field emission structure having a unified solitary structure having separately controllable and addressable emitting regions.

Still another object of the present invention is to provide a fibrous field emission structure having a longitudinally sectioned gate electrode thereon whereby the fibrous field emission structure has separately controllable and addressable emitting sections.

SUMMARY OF THE INVENTION

To achieve the foregoing and other objects, and in accordance with the purposes of the present invention, as embodied and broadly described herein, the present invention provides a unified fibrous field emission element including a conductive fibrous central core element having an insulating material directly thereon the conductive fibrous central core element and a gate electrode directly thereon the insulating material, the conductive fibrous central core element further including emission sites situated longitudinally along the length of the conductive fibrous central core element.

The present invention further provides a fibrous field emission element including a conductive fibrous central core element having an insulating material layer directly thereon the conductive fibrous central core element and a gate electrode layer directly thereon the insulating material layer, the conductive fibrous central core element having emission along the longitudinal length of the conductive fibrous central core element and the gate electrode material layer characterized by multiple longitudinally discontinuous sections of gate electrode material separated by sections of insulating material along the conductive fibrous central core element.

DETAILED DESCRIPTION

The present invention is concerned with a cold field emission structure based on fibers with an insulating layer, gate electrode and emission layers built on or fabricated directly on the fiber.

Figure 1:
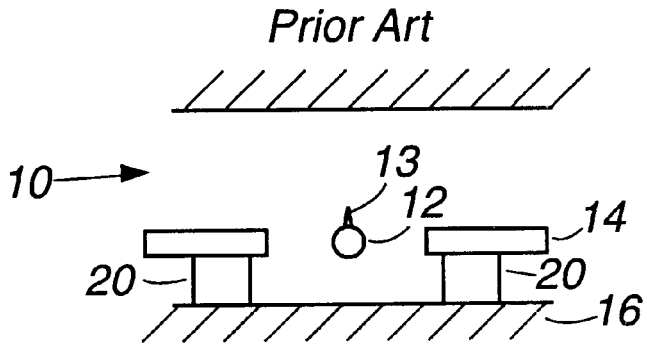
FIG. 1 shows a typical prior art structure involving a fibrous field emitter and a gate electrode.

FIG. 1 shows a typical prior art structure 10 involving a fibrous field emitter 12 and a gate electrode 14 together with cathode 16 and anode 18. The cathode 16 is spaced apart from gate electrode 14 by insulating layer 20. An emission-enhancing coating 13 is shown on fibrous field emitter 12.

Figure 2:
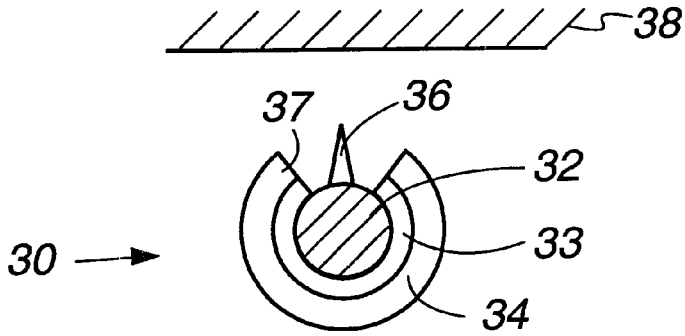
FIG. 2 is shows an embodiment of the present invention wherein a fibrous emitter includes a gate electrode within a single solitary unified structure.

FIG. 2 shows the cold field emission structure 30 of the present invention. A conductive fiber 32 acts as the substrate itself, i.e., the conductive fiber 32 serves as the cathode. An insulating material layer 33 is upon conductive fiber 32 with a gate electrode layer 34 upon the insulating layer 33. Upon the conductive fiber 32 is emission site 36 that can optionally be coated with an emission-enhancing material 37 (not shown). An anode 38 is spaced apart from structure 30. Insulating material layer 33 is generally of a thickness from about 10 nanometers (nm) to about 10,000 nm (10 microns), preferably from about 200 nm to about 1000 nm. Gate electrode layer 34 is generally of a thickness from about 1 mn to about 500 nm, preferably from about 200 nm to about 500 nm, although thinner layers are typically most preferred. Edge 37 of gate electrode layer 34 is shown here as essentially straight.

The fiber in the present invention should be of a material with a relatively low work function, i.e., the material easily gives up electrons upon application of an electrical field, and the material should have a high melting point, i.e., a melting point of at least about 600° C. Generally, the fiber can be made of a conducting material such as molybdenum or doped silicon, i.e., metals or semiconductors. Metals like molybdenum (Mo) or tungsten (W) are especially suitable as the fibers as they are commonly used in previous field emitter designs. However, specific emitter tips or emission sites upon the fiber may be fabricated of another material that is electrically, chemically, and mechanically compatible with the base fiber material.

In some instances, selected fiber material may have a sufficiently high emission such that emitter tips need not be fabricated as a separate structure out of or upon the fiber and the emission can simply occur from edges or roughness upon the fiber. Diamond-coated, diamond-like carbon coated, or amorphic diamond coated fibers may have the necessary emission without the need for fabrication of specific emitter tips.

The design of the emitter tips can generally be of any desired design. For instance, any of the existing emitter tip designs such as seen in U.S. Pat. No. 3,755,704 by Spindt et al. for "Field Emission Cathode Structures and Devices Utilizing Such Structures", U.S. Pat. No. 5,229,331 by Doan et al. for "Method to Form Self-Aligned Gate Structures Around Cold Cathode Emitter Tips Using Chemical Mechanical Polishing Technology" and U.S. Pat. No. 5,243,252 by Kaneko et al. for "Electron Field Emission Device" can be used. Other designs may be incorporated into the solitary structure design of the present invention as well. Fabrication of the emitter tips or sites can be by any method compatible with the chosen materials of the fiber, tip, insulator and gate. Emitter tips can be fabricated by well-established semiconductor microfabrication techniques. Such techniques can produce highly regular arrays of precisely shaped field emission tips. For example, emitter tips can be formed as so-called "Spindt" tips in the method described by Spindt in an article entitled "A Thin-Film Field Emission Cathode" in the Journal Of Applied Physics, Vol. 39, No. 7, pp. 3504–3505 (1968) or the method described in U.S. Pat. No. 3,755,704.

The emitter tips can be fabricated of materials such as silicon, silicon carbide, zirconium carbide, titanium carbide, tungsten, molybdenum, lanthanum hexaboride, carbon, graphite, diamond, diamond-like carbon (DLC), or composites of such materials. Composites may be in the form of mixed phases, layered materials and the like.

In some cases, the emitter tips can include an emitter coating as an emissionenhancing component to obtain the desired low work function. Such emitter coatings can be of materials such as cermet (a ceramic/metal mixture such as chromium silicide and silicon dioxide), cesium, rubidium, tantalum nitride, barium, chromium silicide, titanium carbide, nickel silicide, molybdenum, niobium and the like.

Insulator materials in the present field emission structure can be of silicon dioxide, alumina, silicon oxynitride, silicon nitride, tantalum oxide and the like. Generally, silicon dioxide and alumina are preferred as the insulator material.

Gate materials can be formed of materials such as molybdenum disilicide, tantalum disilicide, tungsten disilicide, titanium disilicide, chromium disilicide, and the like. These materials are exemplary and are not considered limiting as numerous other materials are well known to those skilled in the art for use as gate materials. Generally, molybdenum disilicide, tantalum disilicide and tungsten disilicide are preferred as the gate material.

The shape of the gate electrode is not considered critical to the present invention. That is, the edges of the gate electrode may be straight, angled, curved or the like.

Generally, numerous other materials are known for use as emitter substrates, emitter tips, emission-enhancing components, gate materials, and insulator materials. The present invention is concerned with a new design for the cold field emission structure and should not be considered to be limited to any particular materials.

Figure 3:
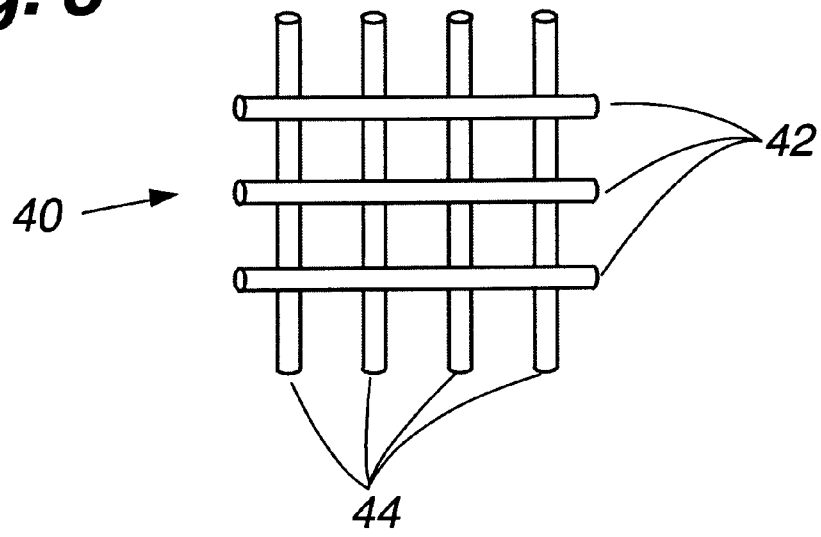
FIG. 3 shows a grid arrangement of anode strips and fiber/gate/emitters in a field emission device.
Figure 4:
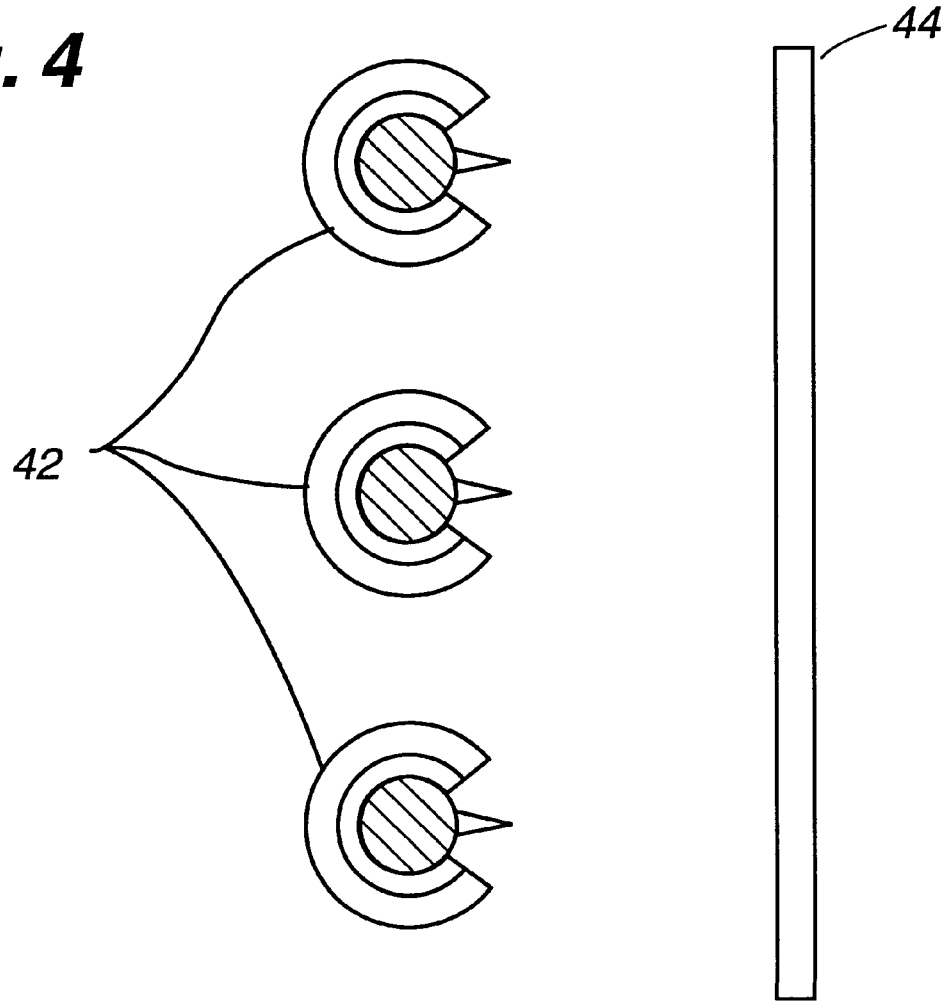
FIG. 4 shows another view of the grid arrangement shown in FIG. 3.

A variation on the cold field emission structure can be considered. As described bove, the cold field emission structure is limited to row-and-column addressing trategies. That is, to achieve emission at selected emission sites as required for the articular field emission display application, the fiber/gate/tip structure often needs to be arranged perpendicular to the anode structure. Comb-geometry field emitter array structures do not need to be arranged in this manner. FIG. 3 shows an assembly 40 including multiple fiber/gate/emission tip structures 42 and multiple anode strips 44 arranged perpendicular to one another. Both the anode strips 44 and fiber/gate/emission tip structures 42 are connected to separate voltage supplies (not shown). FIG. 4 shows another view of the structure in FIG. 3 along an axis of the assembly 40 allowing the view of the fiber/gate/emission tip structures 42, each with the structure shown in FIG. 2.

Figure 5:
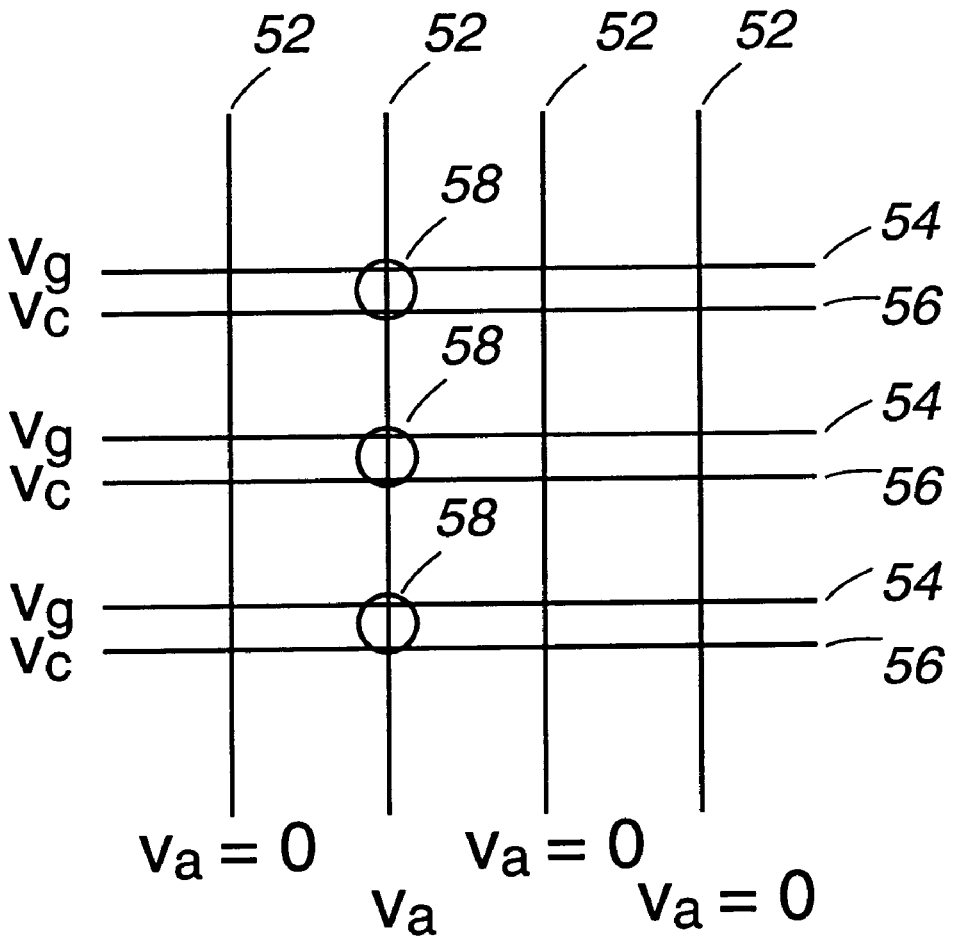
FIG. 5 shows an embodiment of a wiring diagram for an addressable pixel design.

To operate assembly 40, anode strips 44, and both the gate and cathode fiber voltages on fiber/gate/emission tip structures 42 would need to be switched separately producing the correct combination voltage at a particular point on the grid. In a "wiring diagram" form it would look like FIG. 5. FIG. 5 shows vertical anode lines 52, horizontal gate lines 54 and horizontal cathode lines 56. Typically, a voltage on a cathode line 56 may be around −20.0 volts, a voltage on a gate line 54 may be in the range of about 5 to about 20 volts, and a voltage on an anode line 52 may be in the range of about 1000 to about 10,000 volts.

By fixing a line of cathodes and gates at their operating voltages and activating only a single anode strip at its operating voltage, the number of active sites can be limited (in the sample grid 50 of FIG. 5 to three active sites 58). Activating just a single site on this sample grid 50 would require turning off either the gate voltage or the cathode voltage or both gate and cathode voltages on the other fiber/gate/emission structures shown. For example, when the cathode voltage is set to the gate voltage, an emission site can be inactivated.

A problem or limitation with this described design is that it is necessary to switch large voltage over long lengths of electrical elements to operate the device. This leads to large increases in the driver circuitry costs and designs.

It is desirable to address the gates separately to achieve switching in the emission current. With this basic structure there is at least one strategy to achieve this end. A variation in design of the present invention can involve fabricating breaks in the gate electrode to provide electrical isolation from neighboring sections of gate electrode. The sections are grouped and placed in contact with a flat or grooved electrode to control the voltage or the gate.

Figure 6:
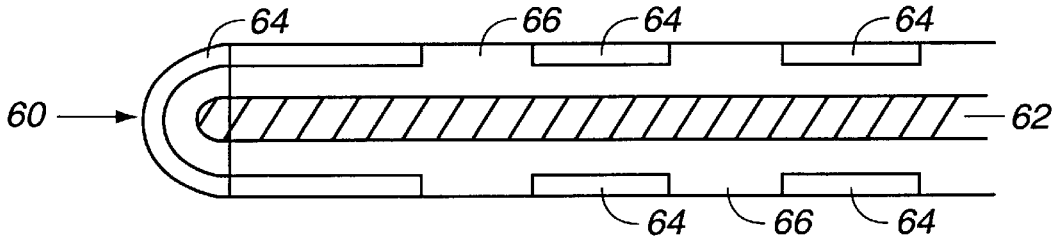
FIG. 6 shows a lengthwise sectional view of a solitary fibrous emitter.

FIG. 6 shows a lengthwise sectional view of a solitary fibrous emitter 60 including a central conductive core 62 and a sectioned gate electrode 64. Insulator material is shown at 66. Voltages can be maintained as before. Emitter tips are then situated in the regions between the gate and the conductive central core fiber.

Figure 7:
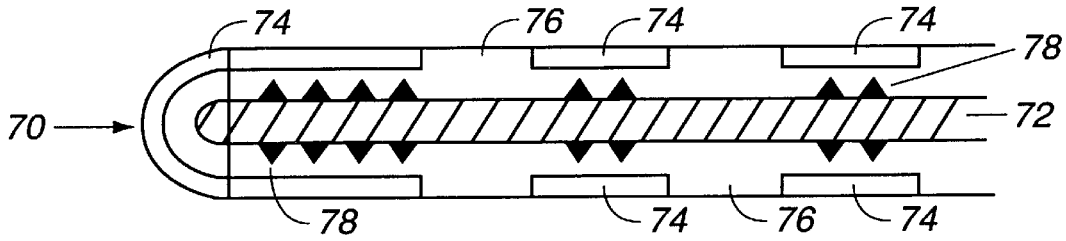
FIG. 7 shows another lengthwise cross-sectional view of a solitary fibrous emitter.

FIG. 7 shows another lengthwise cross-sectional view of a solitary fibrous emitter 70 including a central conductive core 72 and a sectioned gate electrode 74 but also showing emitter tips 78 on both the top and the bottom of the fiber or central conductive core. Insulator material is shown at 76. While not shown in this figure, it is generally preferred that the emitter sites, in this case emitter tips 78, should extend near to the plane of gate electrode 74 for best emission results.

Figure 8:
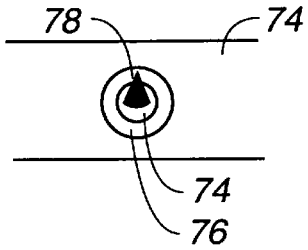
FIG. 8 shows a top view of a sectioned gate electrode.

FIG. 8 shows a top view of a sectioned gate electrode 74 from FIG. 7. Emitter tip 78 is shown upon the visible portion of central conductive core 72. Also seen in this top view is insulator material 76. Preferably, emission tips would include the emission-enhancing coatings. There is no limitation to the pattern of emitter tips imposed on the gate-insulator-fiber structure of the present invention. The anode is not shown.

Figure 9:
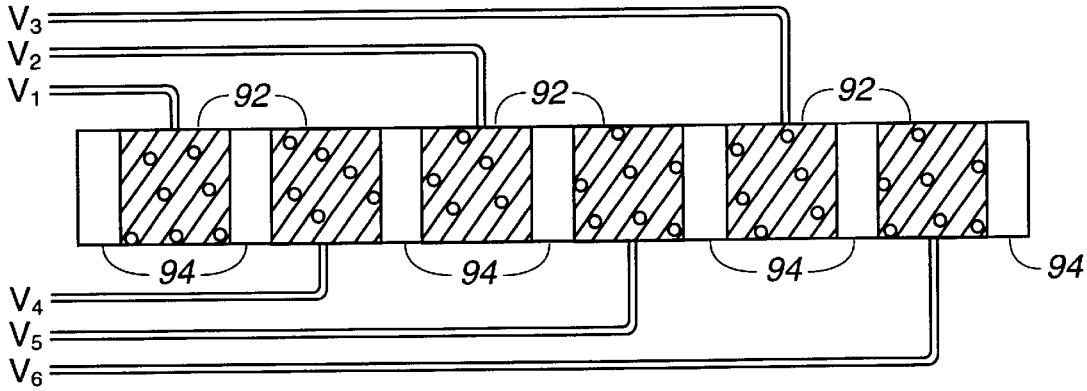
FIG. 9 shows an embodiment wherein the voltage of individual sections of gates can be regulated.

With the design shown in FIGS. 6–8, the voltage of individual sections of gates can now be regulated. This, addressable emission sites can be obtained. This can be accomplished by depositing electrical contact lines with separate voltage regulators. One embodiment of this design is shown in FIG. 9. The top view shows gate electrode sections 92 and insulator sections 94 separating gate electrode sections. The tiny circles within the gate electrode sections denote emission sites within the structure. Voltage contact lines $V_1$–$V_6$ can be controlled at separate voltages. It should be realized that the tiny circles could be of other general shapes such as squares, rectangles, ovals, stars and the like so long as the path of electrons from the emitter tips are not blocked from reaching the anode by the gate electrode material.

Figure 10:
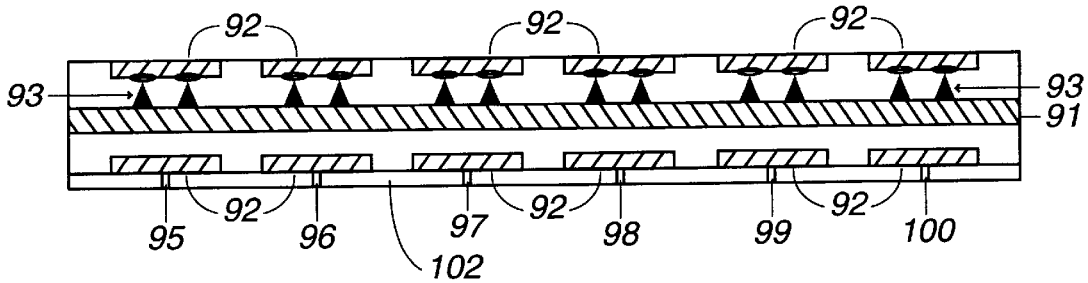
FIG. 10 shows a cross-section longitudinal view of the embodiment seen in FIG. 9.

A cross-section longitudinal view of this embodiment is shown at FIG. 10. FIG. 10 shows gate electrode sections 92 and insulator sections 94 separating gate electrode sections. Also seen are the central conductive core or fiber 91 and the emission sites 93 off of the core 91. Again, the tiny circles within the gate electrode sections denote emission sites within the structure. Voltage contact lines $V_1$–$V_6$ are shown as 95, 96, 97, 98, 99, and 100. For added protection, insulating deposits 102 can be added between the voltage contact lines 95–100.

The width of the contact lines should preferably be less than one half of the width of the insulator bands separating the gate electrode sections to prevent the contacts from touching two regions at once. The width of the contact line is the horizontal dimension shown above. The contact line material may be any sufficiently conductive material such as copper, aluminum or molybdenum.

The cross-sectional shape of the core fiber of the present invention may be other than circular. For example, it may be rectangular in shape as would be common in a tape structure. All of the above teachings also apply to tape forms or fibers having a groove or pie-piece shaped section removed (a Pac-man shaped fiber as in the shape of a character in the once common video game). One method for patterning the contact lines is to fabricate the emitter structure and then to deposit the contacts and associate insulating material on one side of the assemblage using screen printing techniques or electro-less deposition used in the fabrication of plasma emission displays.

The pattern of array tips in the fiber, defined by its aspect ratio of one dimension being greater than the other two, not in terms of its transverse cross-section, can be tailored to the applications. For instance, prior art patterns and tip base diameters are known on the order of several tens of thousands per square millimeter and sub-micron respectively. For instance, in light bulb applications utilizing field emission, all azimuthal orientations may be desirable.

Figure 11:
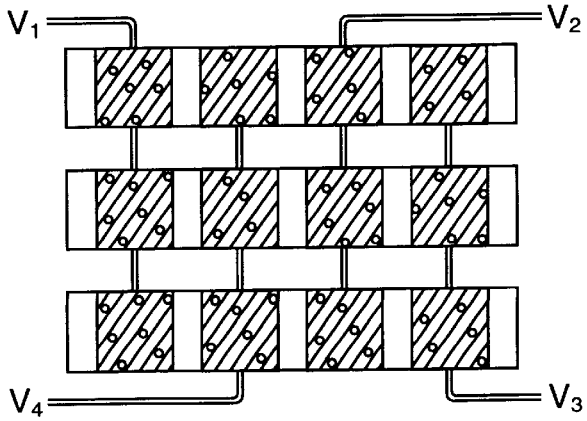
FIG. 11 shows linkage of several sections of gate electrodes through one contact line.

Finally, it is possible to link several sections of gates electrode each or different fibers through one contact line. Such a linkage is shown in FIG. 11 wherein the features (gate electrode sections 92 and insulator sections 94 separating gate electrode sections with the tiny circles denoting emission sites and voltage contact lines $V_1$–$V_4$ controllable at separate voltages) are the same as those in FIG. 9 except that multiple fibers are shown. The number of fibers and the connectivity of gate electrode sections is not limited to those depicted in the present figures. The voltages $V_1$–$V_4$ are not necessarily the same values and the mechanism for their regulation is not shown.

To establish electrical contact between the gate electrode and the contact lines it may be necessary to solder the two together. The current design allows for this possibility. The soldering material must be sufficiently electrically conducting and compatible, both electrically and chemically, with both the gate electrode material and the contact line material and the contact line material.

As for the transverse cross-section shape of contact line and insulating material, the conducting contact line may be flat, bowl-shaped, or angular depending upon support, stability and electrical contact needs. Examples would include a circular transverse section and a cross-sectional core fiber.

Figure 12:
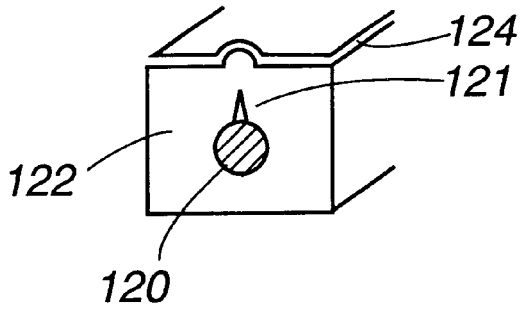
FIG. 12 shows another embodiment wherein a conductive fibrous central core element is combined with non-conformal insulating material and gate electrode material.

It is noted that the gate electrode material and the insulating material in the field emission element structure need not be conformal, that is, the gate electrode material and the insulating material need not be of the same shape in different cross-sections. In a transverse direction, for example, for contact (electrical), mechanical stability and structural support reasons, it may be desirable to fabricate a structure of the form of FIG. 12. In FIG. 12, conductive fibrous central core element 120 with emitter tip 121 has an insulating material 122 surrounding a major portion of the central core element and a generally planar gate electrode layer 124 on the opposing side of emitter tip 121 from central core 120. Thus, it is clear that similar shapes need not be employed. Associated contact lines, if any, and the anode are not shown. In a longitudinal direction, one might undulate, that is, change the thickness of the insulating material layer, the gate electrode layer or both for field enhancement purposes related to better performance.

Again, the general nature of the present invention for gate/emitter/fiber structure must be emphasized. Thus, a comb-geometry field emitter array structure can also be considered wherein a conducting fiber serves as the substrate. These structures (minus the fiber as the substrate) are well-known in the art as described by Matsuzak, et al., J. Electrochem. Soc., v. 144, no. 7, pp. 2538–2541 (July 1997). Such comb-geometry or lateral field emitter arrays are as amenable to fabrication on conducting fibers as are the vertically oriented arrays. In accordance with the present invention, a conducting fiber would be substituted for the substrate.

Although the present invention has been described with reference to specific details, it is not intended that such details should be regarded as limitations upon the scope of the invention, except as and to the extent that they are included in the accompanying claims.

What is claimed is:

1. A unified fibrous field emission element comprising a conductive fibrous central core element having an insulating material layer directly thereon said conductive fibrous central core element and a gate electrode layer directly thereon said insulating material layer, said conductive fibrous central core element further including emission sites situated longitudinally along the conductive fibrous central core element.

2. The unified fibrous field emission element of claim 1 wherein said emission sites further include an emission-enhancing coating.

3. A unified fibrous field emission element comprising a conductive fibrous central core element having an insulating material layer directly thereon said conductive fibrous central core element and a gate electrode layer directly thereon said insulating material layer, said conductive fibrous central core element having emission along the longitudinal length of said conductive fibrous central core element.

4. The unified fibrous field emission element of claim 3 wherein said conductive fibrous central core element further includes an emission-enhancing coating.

5. A unified fibrous field emission element comprising a conductive fibrous centr core element having an insulating material layer directly thereon said conductive fibrous central core element and a gate electrode layer directly thereon said insulating material layer, said conductive fibrous central core element having emission along the longitudinal length of said conductive fibrous central core element and said gate electrode material layer characterized by multiple longitudinally discontinuous sections of gate electrode material separated by sections of insulating material along the conductive fibrous central core element.

6. The united fibrous field emission element of claim 5 wherein said multiple longitudinally discontinuous sections of gate electrode material have separate electrical connections whereby emission from separate sections of the fibrous field emission element can be independently controlled.

* * * * *